US011706558B2

(12) United States Patent
Wei

(10) Patent No.: US 11,706,558 B2
(45) Date of Patent: Jul. 18, 2023

(54) EARPHONE CASE AND EARPHONE ASSEMBLY

(71) Applicant: Anker Innovations Technology Co., Ltd., Changsha (CN)

(72) Inventor: Zheng Wei, Shenzhen (CN)

(73) Assignee: Anker Innovations Technology Co., Ltd., Changsha (CN)

( * ) Notice: Subject to any disclaimer, the term of this patent is extended or adjusted under 35 U.S.C. 154(b) by 107 days.

(21) Appl. No.: 17/298,908

(22) PCT Filed: Dec. 3, 2018

(86) PCT No.: PCT/CN2018/118938
§ 371 (c)(1),
(2) Date: Jun. 1, 2021

(87) PCT Pub. No.: WO2020/113375
PCT Pub. Date: Jun. 11, 2020

(65) Prior Publication Data

US 2022/0060807 A1 Feb. 24, 2022

(51) Int. Cl.
*H04R 25/00* (2006.01)
*H04R 1/10* (2006.01)

(52) U.S. Cl.
CPC ..... *H04R 1/105* (2013.01); *H04R 1/1016* (2013.01); *H04R 1/1058* (2013.01); *H04R 1/1091* (2013.01); *H04R 2201/10* (2013.01)

(58) Field of Classification Search
CPC .... H04R 1/1016; H04R 1/105; H04R 1/1066; H04R 2460/17; H04R 2225/023
See application file for complete search history.

(56) References Cited

U.S. PATENT DOCUMENTS

2013/0004004 A1 1/2013 Zhao et al.
2018/0035196 A1* 2/2018 Yeung ..... H04R 1/1058
2021/0297766 A1 9/2021 Bai et al.

FOREIGN PATENT DOCUMENTS

CN 106210963 A 12/2016
CN 205921729 U 2/2017
(Continued)

OTHER PUBLICATIONS

Aug. 27, 2019 (WO) International Search Report with English Translation—PCT/CN2018/118938.
(Continued)

*Primary Examiner* — Amir H Etesam
(74) *Attorney, Agent, or Firm* — Banner & Witcoff, Ltd.

(57) ABSTRACT

The present invention discloses an earphone cover and an earphone assembly. The earphone cover having a through hole running axially through thereof. The earphone cover comprises a first attachment end, a second attachment end, a support portion, and a space defined by the support portion. The first and second attachment ends are positioned at each end of the through hole respectively. The support portion is set between the first and second attachment ends. The space is configured between an inner surface of the support portion and an outer surface of the earphone. The support portion deforms and air in the space escapes via the first and/or the second attachment ends under compression, and the support portion recovers to an original shape when the compression is removed.

20 Claims, 3 Drawing Sheets

(56) References Cited

FOREIGN PATENT DOCUMENTS

| | | | |
|---|---|---|---|
| CN | 108650577 | A | 10/2018 |
| JP | H7170588 | A | 7/1995 |
| JP | 2003102082 | A | 4/2003 |
| JP | 2013514017 | A | 4/2013 |
| WO | 2010005039 | A1 | 1/2010 |
| WO | 2010031775 | A1 | 3/2010 |
| WO | 2018/058878 | A1 | 4/2018 |
| WO | 2018/058879 | A1 | 4/2018 |

OTHER PUBLICATIONS

Jun. 1, 2022 (EP) Exended Search Report of EP 18 94 2287.
May 31, 2022 (JP) English translation of Notice of Reasons for Refusal App. No. 2021-521486, pp. (6).
Aug. 29, 2022. (JP) English translation of Amendment, pp. (8).
Dec. 21, 2022 (JP) Japanese Office Action of Application No. 2021-521486, pp. (10).

* cited by examiner

EARPHONE CASE AND EARPHONE ASSEMBLY

CROSS REFERENCE TO RELATED APPLICATION

This application is a national stage application, filed under 35 U.S.C. § 371, of International Application No. PCT Application No. PCT/CN2018/118938, filed on Dec. 3, 2018. The entire disclosure of the prior application is incorporated herein by reference.

BACKGROUND OF INVENTION

Technology Field

The present invention relates to the field of earphones and, in particular, to an earphone cover and an earphone assembly comprising thereof.

Technique of the Prior Art

Usually, in order to improve the stability as well as the comfort of wearing earphones, earphone covers are provided on the earphones. But the existing headset covers have a small deformation amount and area. Such structure leads to wearing instability on one hand, and cause extrusion to users on the other hand, makes users feel discomfort.

Therefore, it is necessary to propose a earphone an earphone cover and a earphone assembly including thereof to at least partially solve the problems existing in the prior art.

SUMMARY OF INVENTION

In order to solve the above problem, the present invention provides an earphone cover.

The earphone cover is made of a flexible material and has a through hole running axially there-through. The earphone cover comprises a first attachment end and a second attachment end located at each end of the through hole, and a radially outwardly projecting support portion disposed between the first attachment end and the second attachment end. The first attachment end and the second attachment end are used to attach the earphone cover to the outer surface of the earphone, the support portion is used to attach the earphone cover to the outer surface of the earphone. The support portion is used for supporting in user's cavitas conchae, the support portion defines a space within the support portion such that when the earphone cover is attached to the earphone, the space is spaced between the inner surface of the support portion and the outer surface of the earphone. The support portion is capable of deforming under compression of the ear by the elasticity of its own material to allow air in the space to escape via the first attachment end and/or the second attachment end, and the support part is able to naturally return to its original shape when the earphone is removed from the ear by virtue of the elasticity of its own material.

The support portion is provided at a predetermined position in a circumferential direction around the earphone cover.

The earphone cover has the support portion at least at a position corresponding to the ear armor boat, the crus of helix and the antitragus, and the earphone cover does not have the support portion at a position corresponding to the antilobium.

The support portion includes a recessed portion for mating with the crus of helix, the recessed portion is recessed inwardly in the axial direction of the earphone cover.

The peripheral dimensions of the earphone cover taper from the radially outermost end of the support portion to the first attachment end, and taper from the radially outermost end of the support portion to the second attachment end.

The radially outermost end of the support portion is in substantially the same plane as the second attachment end.

The headset sleeve has a uniform wall thickness.

The earphone cover is not perfectly uniform in shape along the circumferential direction.

The present invention also provides an earphone assembly comprises an earphone and an earphone cover as described above, the earphone cover is removably snapped onto the earphone.

The headphone is provided with a positioning slot on the outer surface of the earphone along the circumferential direction of the earphone, and the earphone cover is snapped into the positioning slot.

The earphone cover and earphone assembly according to the present invention defining a space within the support portion positioned in user's cavitas conchae, so that when the earphone cover is placed over the earphone, the inner surface of the support portion and the outer surface of the earphone are separated. In this solution, when user wears the earphone assembly 4, the support portion can deform according to the structure of the cavitas conchae, so that the support portion can adjust its own shape to fit the structure of cavitas conchae, to make the earphone cover fits more closely to the cavitas conchae and does not overly squeeze user's ear. This solution improves wearing stability and comfort, ease manufacture, and low the cost.

A series of concepts in simplified form are introduced in the content of the invention, which will be described in detail with specific embodiments. The content section of the present invention is not meant to attempt to limit the essential technical features of the claimed technical solution, and not attempt to limit the scope of the claimed technical solution.

Advantages and features of the present invention will be described in conjunction with the accompanying drawings.

BRIEF DESCRIPTION OF DRAWINGS

The following accompanying drawings of the present invention are used herein as part of the present invention for the purpose of understanding the present invention. Embodiments of the invention and a description thereof are shown in the accompanying drawings to explain the principles of the invention.

ILLUSTRATION OF THE MARKS IN THE DRAWINGS

Figure 1:
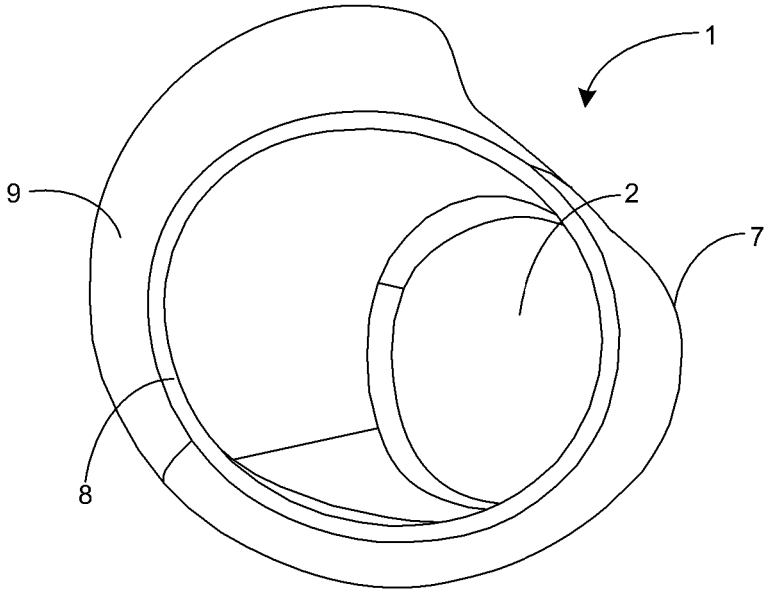
FIG. 1 is a perspective view of an earphone cover according to an embodiment of the present invention.

1. earphone cover
2. through hole
3. earphone
4. earphone assembly
5. Positioning slot
6. Cavitas conchae
7. First attachment end
8. Second attachment end
9. Support portion
10. Inner end
11. Outer end
12. Space
13. Cavum conchae
14. Antitragus
15. Antilobium
16. Recessed portion
17. Ears
18. Crus of helix

DETAILED DESCRIPTION OF EMBODIMENTS

In the description below, specific detail is given in order to provide a good understanding of the present invention. However, it will be apparent to those skilled in the art that the present invention can be carried out without one or more of these details. In other examples, some technical features well known in the art are not described in order to avoid confusion with the present invention.

For a thorough understanding of the present invention, a detailed structure will be presented in the following description. It is clear that the embodiments of the invention are not limited to particular details familiar to those skilled in the art. The preferred embodiment of the invention is described in detail below, however, the invention may have other embodiments in addition to these detailed descriptions.

Hereinafter, the earphone cover and earphone assembly of an embodiment of the present invention are described with reference to the accompanying drawings.

Figure 2:
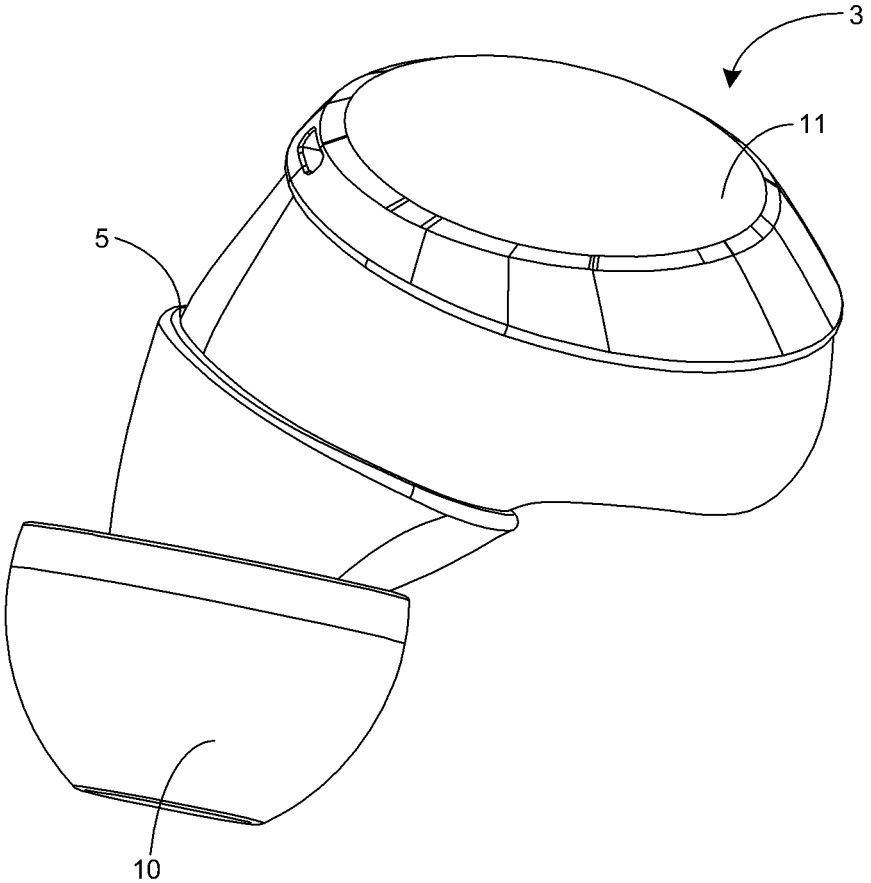
FIG. 2 is a perspective view of a earphone for use with the earphone cover according to a an embodiment of the present invention.
Figure 3:
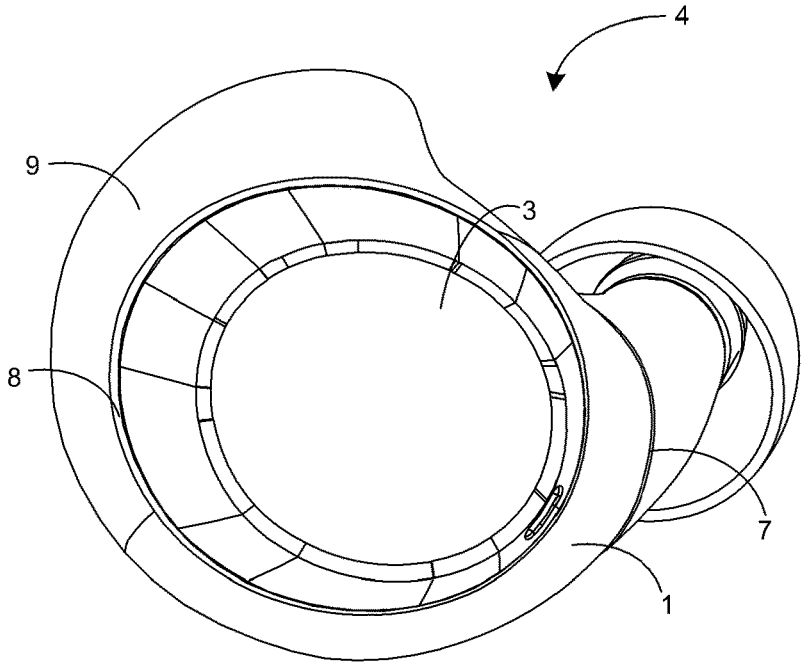
FIG. 3 is a perspective view of an earphone assembly including an earphone and an earphone cover according to an embodiment of the present invention.
Figure 4:
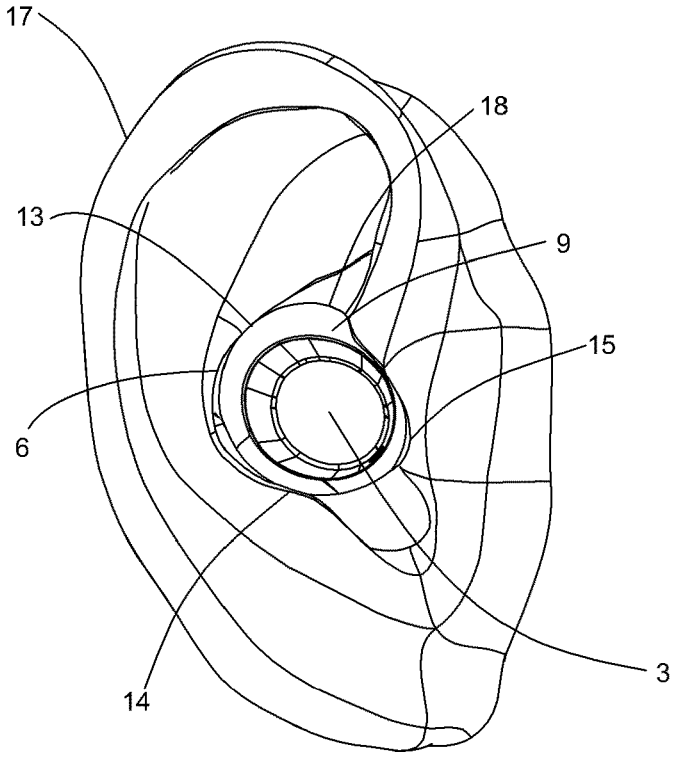
FIG. 4 is a schematic diagram of the earphone assembly according to an embodiment of the present invention when worn in the ear of a user.

FIG. 1 is an earphone cover according to a preferred embodiment of the present invention, FIG. 2 is an earphone according to a preferred embodiment of the present invention, FIG. 3 is an earphone assembly including an earphone cover and earphone according to a preferred embodiment of the present invention, and FIG. 4 is a schematic view of the earphone assembly according to a preferred embodiment of the present invention when worn in a user's ear. As shown in FIG. 1-FIG. 4, an earphone cover 1 has a through hole 2 running along an axial direction of the earphone cover 1. The earphone cover 1 is snapped onto an earphone 3 through the through hole 2 to form an earphone assembly 4. Preferably, the earphone cover 1 is removably snapped onto the earphone 3, so that user could change the earphone cover as needed. The headset cover 1 can be made of flexible deformable materials such as silicone, rubber, etc., to increase wearing comfort and facilitate disassembly.

An outer surface of the earphone 3 is provided with a positioning slot 5. The positioning slot 5 extends in a circumferential direction of the earphone 3. A profile of the positioning slot 5 is same as a profile of an inner surface of the earphone cover 1, so that the earphone cover 1 could be positioned in the positioning slot correspondingly. Further, the positioning slot 5 has an irregular shape along the circumferential direction, and accordingly, the earphone cover 1 has an irregular shape along the circumferential direction. This preferred embodiment can produce an anti-dulling effect in the assembly process of the earphone cover 1, so that the earphone cover 1 can be assembled on the earphone 3 in a predetermined orientation, facilitating the assembly of the earphone cover 1. It will be understood that in other embodiments not shown, the outer surface of the earphone 3 may also be provided without the positioning slot 5, and the earphone cover 1 may be placed directly over the outer surface of the earphone 3. When a user wears the earphone 3 with the earphone cover 1 in ear 17, the earphone cover 1 can fit into the user's cavitas conchae 6 to hold the earphone 3 more securely in the ear 17.

Figure 5:
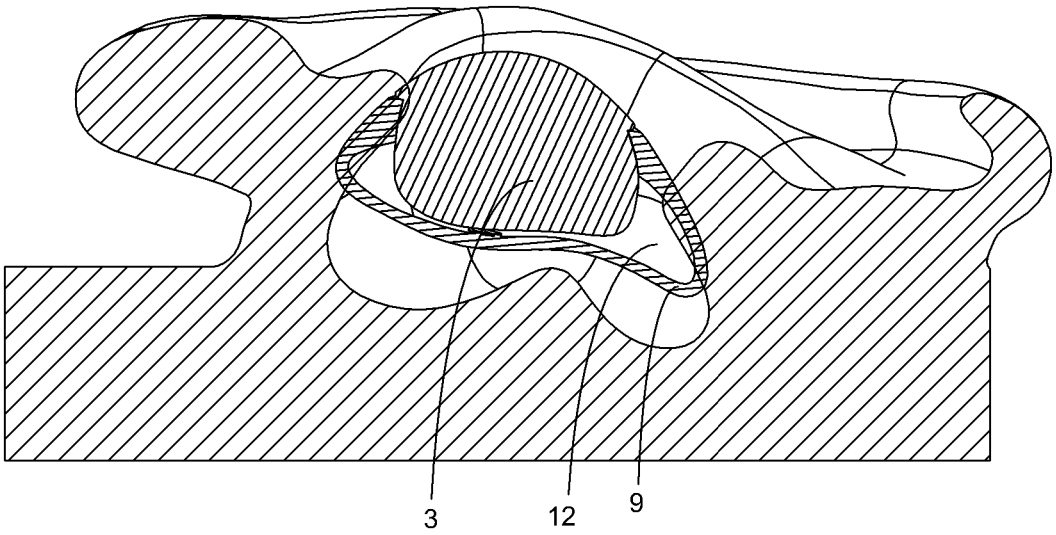
FIG. 5 is a cross-sectional view of an earphone assembly according to a preferred embodiment of the present invention when worn in the ear of a user.

As shown in FIG. 1, the earphone cover 1 includes a first attachment end 7, a second attachment end 8, and a support portion 9, which are located at the ends of the through hole 2, respectively. The first attachment end 7 and the second attachment end 8 are each attached to the outer surface of the earphone 3. The first attachment end 7 is set closer to an inner end 10 (i.e., a speaker end) of the earphone 3 than the second attachment end 8, and the second attachment end 8 is set close to an outer end 11 of the earphone 3. The support portion 9 is located between the first attachment end 7 and the second attachment end 8. The support portion 9 projects outward in a radial direction of the earphone cover 1. The support portion 9 used for supporting in the user's cavitas conchae 6 when the earphone 3 is worn. The support portion 9 is substantially curved. In combination with FIG. 5, when the earphone cover 1 is placed over the earphone 3, the inner surface of the support part 9 and the outer surface of the earphone 3 form a space 12, the space 12 is located between the support part 9 and the earphone 3, and separates the support part 9 and the earphone 3. When the user wears the earphone assembly 4, the support portion 9 could deform under pressure based on its own elasticity, so that air in the space 12 could escape via the first attachment end 7 or the second attachment end 8. When the earphone assembly 4 is removed from the ear, the support portion 9 is able to naturally recover to its original shape based on its own elasticity.

The support portion 9 is provided in a circumferential direction around the earphone cover 1, and a person skilled in the art may provide the above-mentioned support portion 9 at a suitable location according to actual needs. Further, when the user wears the earphone assembly 4, the support portion 9 could be in contact with at least the user's cavum conchae 13, crus of helix 18 and antitragus 14. Further, the support portion 9 separates from user's antilobium 15, which means, at user's antilobium 15, an inner surface of the earphone cover 1 is directly affixed to an outer surface of the earphone 3.

The above solution allows the support portion 9 deforms according to the structure of the user's cavitas conchae 6. The support portion 9 could adjust its own shape to fit the structure of the cavitas conchae 6 according to the deformation of the structure of the cavum conchae 13, the crus of helix 18 and the antitragus 14. Because the inner surface of the earphone cover 1 fits directly to the outer surface of the earphone 3 at user's antilobium 15, earphone cover 1 fit more closely to the cavitas conchae 6. This solution can improve the stability and comfort of wearing, ease the manufacture, and low the cost.

Figure 6:
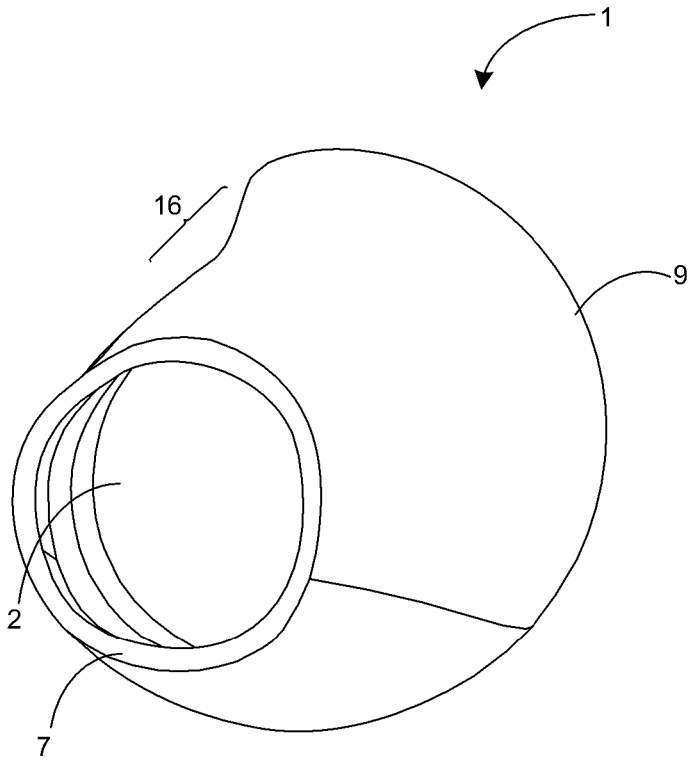
FIG. 6 is another perspective view of the earphone cover according to an embodiment of the present invention.

As shown in FIG. 6, the support portion 9 is provided with a recessed portion 16 which is recessed inwardly in the axial direction of the earphone cover 1 for fitting to the user's crus of helix after being worn by the user. That is, when wearing the earphone assembly 4, the user's crus of helix can be accommodated within this recessed portion 16 to avoid the crus of helix from pushing against the earphone cover 1, so that the earphone cover 1 could be worn more securely.

In a preferred embodiment, to facilitate the manufacture of the earphone cover 1, the earphone cover 1 can be formed in one piece by, for example, injection molding, and the earphone cover 1 could have a uniform wall thickness. This solution ease the manufacture the earphone cover 1

As shown in FIG. 1 and FIG. 6, the peripheral dimension of the earphone 1 tapers from the radially outermost end of the support portion 9 to the first attachment end 7, and tapers from the radially outermost end of the support portion 9 to the second attachment end 8. Further, a radially outermost end of the support portion 9 is approximately in a same plane as the second attachment end 8.

For the earphone cover 1 and the earphone assembly 4, the inner surface of the support portion 9 and the outer surface of the earphone 3 form a space 12, the space 12 is located between the support portion 9 and the earphone 3 and separates the support portion 9 and the earphone 3. The support portion 9 can be deformed according to the structure of user's cavitas conchae 6, so that the support portion 9 can adjust its own shape to fit the structure of user's cavitas conchae 6, to make the earphone cover 1 fits more closely to the cavitas conchae 6 and does not overly squeeze user's ear. This solution improves wearing stability and comfort, ease manufacture, and low the cost.

It should be understood that the above only describes in detail the preferred embodiment of the present invention, and the present invention is not limited to the above preferred embodiment, and the person skilled in the art may make appropriate modifications and variations of the above embodiment.

The present invention has been illustrated by the above-described embodiments, but it should be understood that the above-described embodiments are used only for the purpose of example and illustration and are not intended to limit the invention to the scope of the described embodiments. Furthermore it will be understood by those skilled in the art that the present invention is not limited to the above mentioned embodiments, and that more variations and modifications may be made in accordance with the teachings of the present invention, all of which fall within the scope of protection claimed by the present invention. The scope of the invention is defined by the appended claims and their equivalent scope.

What is claimed:

1. An earphone cover comprising:
an interval cavity;
a first end at one side of the interval cavity;
a second end at another side of the interval cavity; and
a radially outwardly protruding flexible support portion disposed between the first end and the second end, wherein:
the first end and the second end are configured to attach the earphone cover to an outer surface of an earphone, and the support portion is configured to support a concha cavity of an ear of a user,
a space is formed between an inner surface of the support portion and an outer surface of the earphone, and
air in the space is expelled, via at least one of the first end or the second end, when the earphone is worn by the user.

2. The earphone cover according to claim 1, wherein the support portion, when worn by the user, touches the user's cavum conchae, crus of helix, and antitragus, and does not touch the user's antilobium.

3. The earphone cover according to claim 1, wherein the support portion comprises a recessed portion inward in an axial direction of the earphone cover.

4. The earphone cover according to claim 1, wherein a perimeter of the first end and a perimeter of the second end are different.

5. The earphone cover according to claim 4, wherein a radially outermost end of the support portion is in a same plane as the second end.

6. The earphone cover according to claim 1, wherein the support portion has a uniform thickness.

7. The earphone cover according to claim 1, wherein the earphone cover has an irregular shape along a circumferential direction.

8. The earphone cover according to claim 1, wherein the support portion changes to a different shape after the earphone is removed from the earphone cover.

9. A method for coupling an earphone cover to an earphone, wherein the earphone cover comprises:
an interval cavity;
a first end at one side of the interval cavity;
a second end at another side of the interval cavity; and
a radially outwardly protruding flexible support portion disposed between the first end and the second end, wherein the first end and the second end are configured to attach the earphone cover to an outer surface of an earphone, and the support portion is configured to support a concha cavity of an ear of a user; and
the method comprising:
placing the earphone cover over the earphone to encase at least a portion of the earphone such as an inner surface of the support portion is attached to an outer surface of the earphone; and
expelling, via at least one of the first end or the second end, air from a space between the inner surface of the support portion and the outer surface of the earphone.

10. The method according to claim 9, wherein the support portion comprises a recessed portion inward in an axial direction of the earphone cover.

11. The method according to claim 9, wherein the support portion changes to a different shape after the earphone is removed from the earphone cover.

12. The method according to claim 9, wherein the earphone cover has an irregular shape along a circumferential direction.

13. An earphone system comprising:
an earphone; and
an earphone cover configured to encase at least a portion of the earphone, wherein the earphone cover comprises:
an interval cavity;
a first end at one side of the interval cavity;
a second end at another side of the interval cavity; and
a radially outwardly protruding flexible support portion disposed between the first end and the second end, wherein:
the first end and the second end are configured to attach the earphone cover to an outer surface of an earphone, and the support portion is configured to support a concha cavity of an ear of a user, a space is formed between an inner surface of the flexible support portion and an outer surface of the earphone, and air in the space is expelled, via at least one of the first end or the second end, when the earphone is in the ear.

14. The earphone system according to claim 13, wherein the support portion changes to a different shape after the earphone is removed from the earphone cover.

15. The earphone system according to claim 13, wherein the support portion comprises a recessed portion inward in an axial direction of the earphone cover.

16. The earphone system according to claim 13, wherein a radially outermost end of the support portion is in a same plane as the second end.

17. The earphone system according to claim 13, wherein a perimeter of the first end and a perimeter of the second end are different.

18. The earphone cover according to claim 1, wherein when the earphone is removed from the ear, the support portion is configured to restore to a position prior to the first end receiving the earphone.

19. The earphone system according to claim 13, wherein when the earphone is removed from the ear, the support portion is configured to restore to a position prior to the first end receiving the earphone.

20. The earphone system according to claim 13, wherein the earphone cover is attached to a positioning slot on the outer surface of the earphone.

* * * * *